US010619412B2

(12) United States Patent
Chen et al.

(10) Patent No.: US 10,619,412 B2
(45) Date of Patent: Apr. 14, 2020

(54) SLAT OF WINDOW COVERING

(71) Applicant: NIEN MADE ENTERPRISE CO., LTD., Taichung (TW)

(72) Inventors: Lin Chen, Guangdong (CN); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 150 days.

(21) Appl. No.: 15/715,826

(22) Filed: Sep. 26, 2017

(65) Prior Publication Data

US 2019/0093425 A1 Mar. 28, 2019

(51) Int. Cl.

| | |
|---|---|
| ***E06B 9/386*** | (2006.01) |
| *E06B 7/08* | (2006.01) |
| *E06B 7/09* | (2006.01) |

(52) U.S. Cl.

CPC ..... *E06B 9/386* (2013.01); *E06B 7/08* (2013.01); *E06B 7/09* (2013.01)

(58) Field of Classification Search

CPC ..... E06B 9/386; E06B 2009/1505; E06B 2009/1511; E06B 7/082

USPC ..... 160/236

See application file for complete search history.

(56) References Cited

U.S. PATENT DOCUMENTS 1,526,172 A * 2/1925 Near ..... B65H 75/06 160/236
1,609,319 A * 12/1926 Smith ..... B65H 75/06 160/236
1,639,474 A * 8/1927 Whitmore ..... E06B 9/386 160/236
1,659,282 A * 2/1928 Scheffey ..... B65H 75/06 160/236
1,975,906 A * 10/1934 Stewart ..... B65H 75/06 160/236
2,068,977 A * 1/1937 Dodge ..... E06B 9/386 156/65
2,091,012 A * 8/1937 Pratt ..... E06B 9/386 160/232

(Continued)

FOREIGN PATENT DOCUMENTS

CN 206071407 U 4/2017
JP 05280271 A * 10/1993

OTHER PUBLICATIONS

United Kingdom Intellectual Property Office, Combined Search and Examination Report, dated Nov. 30, 2018, 6 pages.

*Primary Examiner* — Johnnie A. Shablack

(74) *Attorney, Agent, or Firm* — Muncy, Geissler, Olds & Lowe, P.C.

(57) ABSTRACT

A window covering slat includes a core material and a covering layer covering thereon. The core material is substantially long, and a surface thereof could be divided into two side surfaces and a continuous surface, wherein one of the side surfaces is on one side of the core material in a longitudinal direction, and the other one of the side surfaces is on the other side of the core material in the longitudinal direction. The continuous surface connects the peripheries of the side surfaces. The continuous surface has a flat segment provided in the longitudinal direction. The covering layer covers the continuous surface, wherein the covering layer has a greater thickness on the flat segment than on any other parts of the continuous surface.

9 Claims, 4 Drawing Sheets

(56) References Cited

U.S. PATENT DOCUMENTS 2,121,217 A * 6/1938 Ellis ..... E06B 9/386 160/236
2,169,873 A * 8/1939 Clark, Jr. ..... E06B 9/386 160/178.1 R
2,534,673 A * 12/1950 Holland ..... E06B 9/386 160/236
2,590,204 A * 3/1952 Phillips ..... E06B 9/386 160/236
2,855,039 A * 10/1958 Gross ..... E04B 1/8209 160/236
3,031,013 A * 4/1962 Russell ..... E06B 7/084 160/201
3,234,996 A * 2/1966 King ..... E04B 1/86 16/225
4,049,038 A * 9/1977 Hyman ..... E06B 9/386 160/166.1
4,276,954 A * 7/1981 Romano ..... E06B 7/084 160/236
4,336,834 A * 6/1982 Schaller ..... E06B 9/386 160/168.1 R
4,818,590 A * 4/1989 Prince ..... A47B 96/206 428/213
4,877,077 A * 10/1989 Ebert ..... E06B 9/386 160/236
4,893,667 A * 1/1990 Dunn ..... E06B 9/386 160/166.1
5,072,561 A * 12/1991 Pitt ..... E06B 7/082 52/473
5,089,348 A * 2/1992 Louderback ..... B32B 27/04 428/464
5,119,871 A * 6/1992 Schwaegerle ..... B32B 27/20 160/236
5,121,785 A * 6/1992 Ohsumi ..... B32B 21/04 160/236
5,127,802 A * 7/1992 Carlson ..... B29C 44/18 29/889.71
5,141,042 A * 8/1992 Schwaegerle ..... E06B 9/386 160/236
5,191,735 A * 3/1993 Ross ..... E06B 7/086 49/403
5,194,209 A * 3/1993 Schwaegerle ..... B32B 27/20 264/132
5,496,630 A 3/1996 Hawrylko et al.
5,595,536 A * 1/1997 Cornell ..... B63B 19/04 114/177
5,597,620 A * 1/1997 Martino ..... B05D 5/061 427/262
5,747,556 A * 5/1998 Schwaegerle ..... C08K 3/22 523/171
D409,869 S * 5/1999 Marusak ..... E06B 9/386 D6/577
5,989,681 A * 11/1999 Martino ..... B05D 5/061 428/15
5,996,672 A * 12/1999 Kotin ..... E06B 9/386 160/236
6,006,816 A * 12/1999 Biro ..... E06B 9/386 160/168.1 R
6,015,002 A 1/2000 Biro
6,083,601 A * 7/2000 Prince ..... B27N 3/005 428/71
6,125,906 A * 10/2000 Kotin ..... B44F 1/00 160/236
6,219,985 B1 4/2001 Hsu
D448,493 S * 9/2001 Franson ..... E06B 9/386 D25/119
6,296,037 B1 * 10/2001 Ruggles ..... E06B 9/386 160/168.1 V
D460,309 S * 7/2002 Gilmore ..... E04B 1/8209 D6/580
D462,458 S * 9/2002 Hughes ..... E06B 7/084 D25/122
6,497,266 B1 * 12/2002 Palmer ..... E06B 9/386 156/308.2
D468,453 S * 1/2003 Schrader ..... E06B 9/386 D25/121
6,505,667 B2 * 1/2003 Levy ..... B29C 63/044 160/236
D571,593 S * 6/2008 Chen ..... C08K 3/22 D6/577
7,503,371 B2 * 3/2009 Lee ..... E06B 9/386 160/236
7,921,602 B2 * 4/2011 Ohanesian ..... E06B 7/08 49/403
9,516,966 B2 * 12/2016 Furusawa ..... G10K 11/168
9,598,899 B2 * 3/2017 Spanjaard ..... E06B 9/386
2003/0168183 A1 * 9/2003 Franco ..... E06B 9/386 160/166.1
2004/0055714 A1 * 3/2004 Nien ..... E06B 9/386 160/236
2005/0255295 A1 * 11/2005 Lin ..... E06B 9/386 428/166
2005/0269044 A1 * 12/2005 Nien ..... E06B 9/386 160/236
2006/0021719 A1 * 2/2006 Chu ..... B32B 3/04 160/236
2006/0113046 A1 * 6/2006 Prince ..... E06B 9/386 160/236
2006/0177682 A1 * 8/2006 Nien ..... E06B 9/386 428/528
2006/0196617 A1 * 9/2006 Barkman ..... E06B 9/386 160/236
2006/0217015 A1 * 9/2006 Chen ..... B32B 3/16 442/36
2007/0009704 A1 * 1/2007 Coppo ..... B32B 21/04 428/76
2007/0151678 A1 * 7/2007 Chen ..... B29C 57/00 160/236
2007/0221344 A1 * 9/2007 Beach ..... E06B 9/386 160/236
2007/0277940 A1 * 12/2007 Chen ..... B29C 57/00 160/236
2007/0284064 A1 * 12/2007 Liu ..... E06B 9/386 160/236
2008/0220224 A1 * 9/2008 Tokumoto ..... B32B 7/12 428/195.1
2008/0245489 A1 * 10/2008 Chuang ..... E06B 7/08 160/236
2008/0264581 A1 * 10/2008 Lee ..... E06B 9/386 160/236
2009/0117337 A1 * 5/2009 Chen ..... B32B 5/26 428/174
2009/0126879 A1 * 5/2009 Chen ..... E06B 9/386 160/236
2010/0015420 A1 * 1/2010 Riebel ..... B32B 27/06 428/203
2011/0024060 A1 * 2/2011 Brownbill ..... E04F 11/1842 160/188
2013/0092330 A1 * 4/2013 Robbins, III ..... E06B 3/80 160/332
2014/0259932 A1 * 9/2014 Stafford ..... E06B 7/084 49/92.1
2014/0262073 A1 * 9/2014 Timmons ..... E06B 7/086 160/218
2014/0262074 A1 * 9/2014 Lee ..... E06B 9/266 160/236
2018/0023338 A1 * 1/2018 Werner ..... E04D 1/26 160/167 R
2018/0117789 A1 * 5/2018 Schmid ..... B29C 63/042
2019/0093425 A1 * 3/2019 Chen ..... E06B 9/386

* cited by examiner (Prior Art)

SLAT OF WINDOW COVERING

BACKGROUND OF THE INVENTION

1. Technical Field

The present invention relates generally to a window covering, and more particularly to a slat of a window covering.

2. Description of Related Art

As shown in FIG. 1 and FIG. 2, a conventional window shutter is usually provided with a plurality of slats 10, which can be turned to adjust the amount of light passing through the window shutter. In general, each of the slats 10 is a long and narrow piece, which is basically constituted of a core material 12 covered by a covering layer 14, wherein the cross-section of the core material 12 is approximately spindle-shaped. Said core material 12 is processed by cutting and trimming, so as to create continuous and gradual curves on top and bottom surfaces thereof. The covering layer 14 wraps around the core material 12 with a uniform thickness, whereby to protect the covered core material 12 from humidity and scratch.

The slats used in a window shutter have to be made long in shape, and are usually fixed onto a fixture (e.g., the frame of a window sash) with two ends thereof. Since the slats have no additional supporting structure in their middle section, and a rod which can be used to adjust the angle of the slats may be further provided in the middle section to meet different requirements for manipulating the shutter, the slats may sag or deform due to their own weight after being used for a long period of time, leading to poor enclosure or intermittent operation. Furthermore, the slats may even get fractured if applied with force in improper ways. Therefore, to effectively avoid the problems mentioned above, the slats would be preferred to have a bending resistance capability greater than conventional designs.

BRIEF SUMMARY OF THE INVENTION

One aspect of the present invention is to provide a slat of a window covering, and said slat could provide a better bending resistance capability through the improvements in structure.

An embodiment of the present invention provides a slat of a window covering, wherein the slat includes a core material and a covering layer. The core material is long and narrow, and has a side surface on each of two sides in a longitudinal direction, respectively. A surface of the core material between the side surfaces is defined as a continuous surface, which has at least one flat segment. The covering layer covers the continuous surface of the core material. A thickness of the covering layer on the at least one flat segment is greater than a thickness of the covering layer on any other parts of the continuous surface.

In an embodiment, the core material is defined to have a transverse direction perpendicular to the longitudinal direction. A length of the at least one flat segment of the continuous surface in the transverse direction is 1% to 80% of a length of the core material in the transverse direction.

In an embodiment, the at least one flat segment connects the side surfaces located at the two ends of the core material in the longitudinal direction.

In an embodiment, the at least one flat segment of the core material includes two flat segments, and the flat segments are respectively located on different sides of the continuous surface.

In an embodiment, a thickness of the covering layer on one of the flat segments equals a thickness of the covering layer on the other one of the flat segments.

In an embodiment, the core material is defined to have a transverse direction perpendicular to the longitudinal direction. A length of each of the flat segments in the transverse direction is 1% to 80% of a length of the core material in the transverse direction.

In an embodiment, the lengths of the flat segments of the continuous surface in the transverse direction are equal.

In an embodiment, the flat segments of the continuous surface are parallel to each other.

In an embodiment, each of the flat segments of the continuous surface connects the side surfaces located at the two ends of the core material in the longitudinal direction, respectively.

In an embodiment, the core material has uneven density, and a part thereof provided with the at least one flat segment has a highest density.

In an embodiment, the core material is made of a medium-density fiberboard.

In an embodiment, the covering layer is a cured liquid coating coated on the continuous surface of the core material.

By providing the flat segment on the continuous surface of the core material in the longitudinal direction, and by covering the flat segment with the thicker covering layer, a bending resistance capability of the slat could be greater than a conventional slat. Therefore, the slat provided in the present invention would not deform even after being used for a long period, and would be less likely fractured by an external force.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
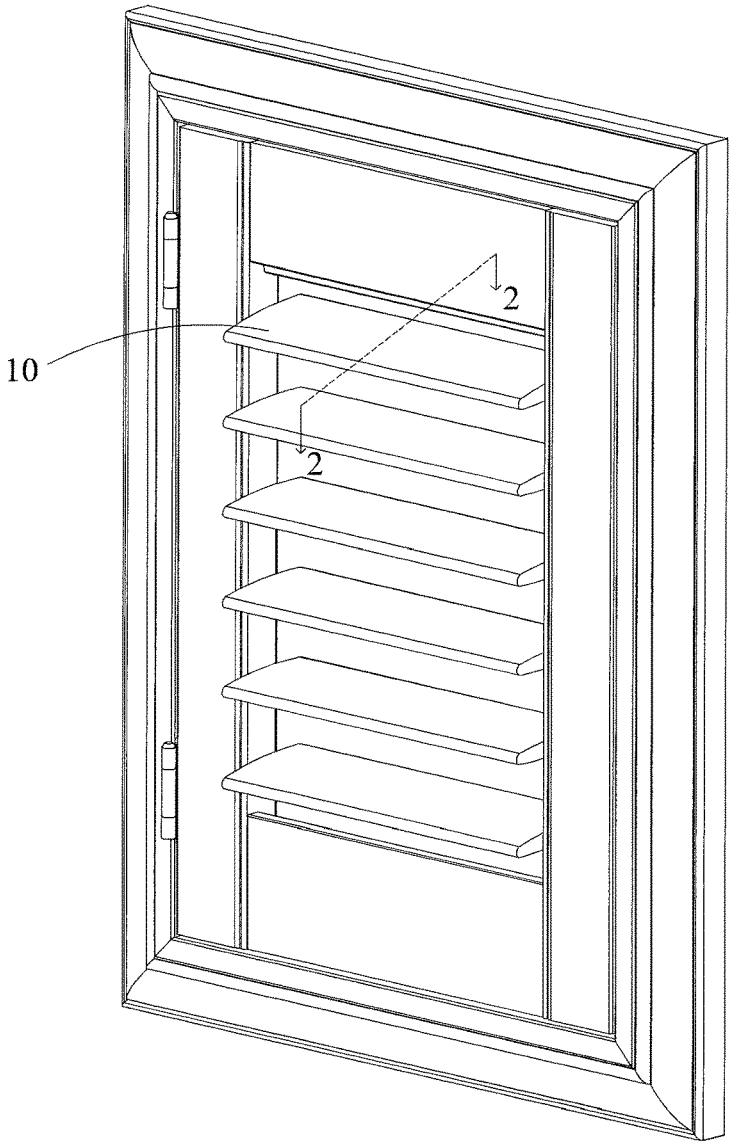
FIG. 1 is a schematic view of a conventional window shutter.
Figure 3:
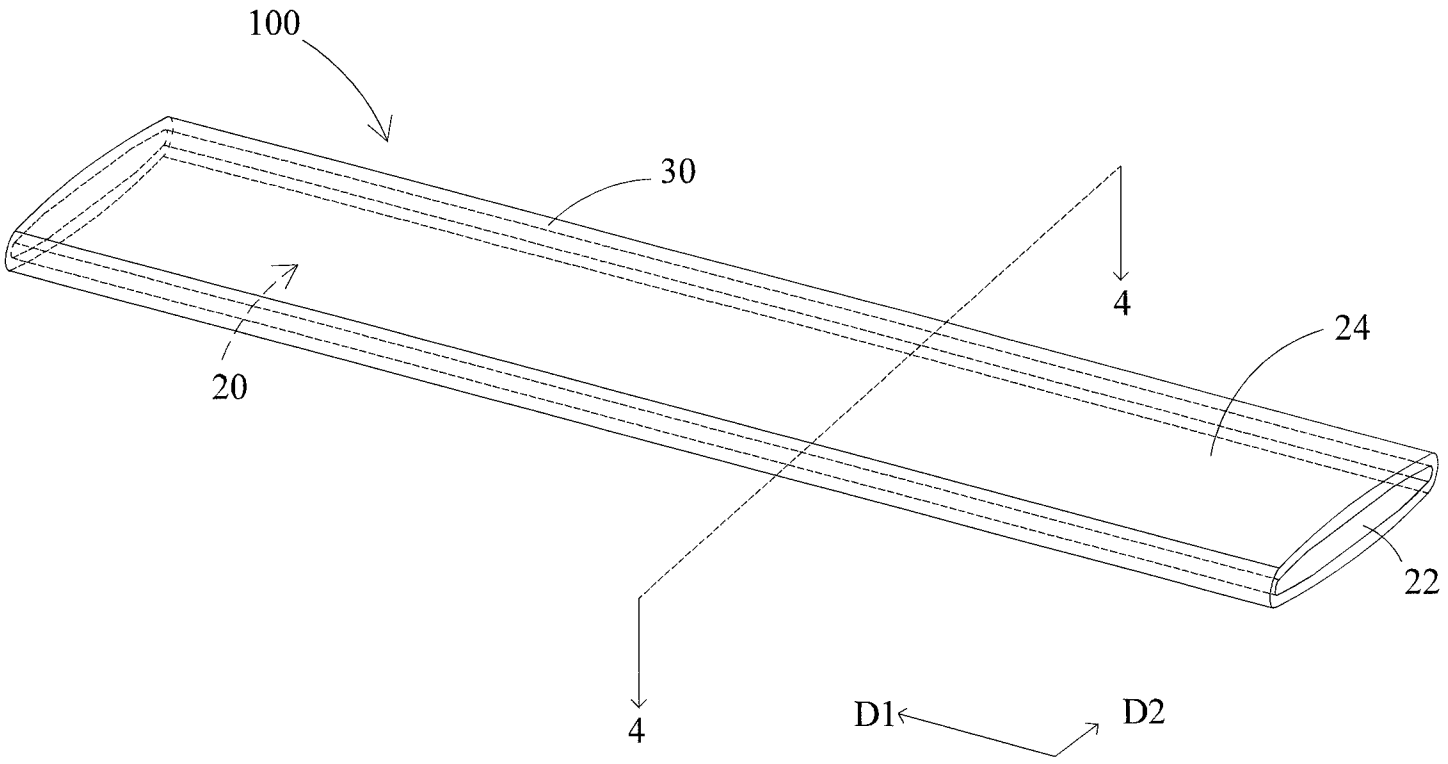
FIG. 3 is a schematic view of the slat of the window covering of an embodiment of the present invention.
Figure 4:
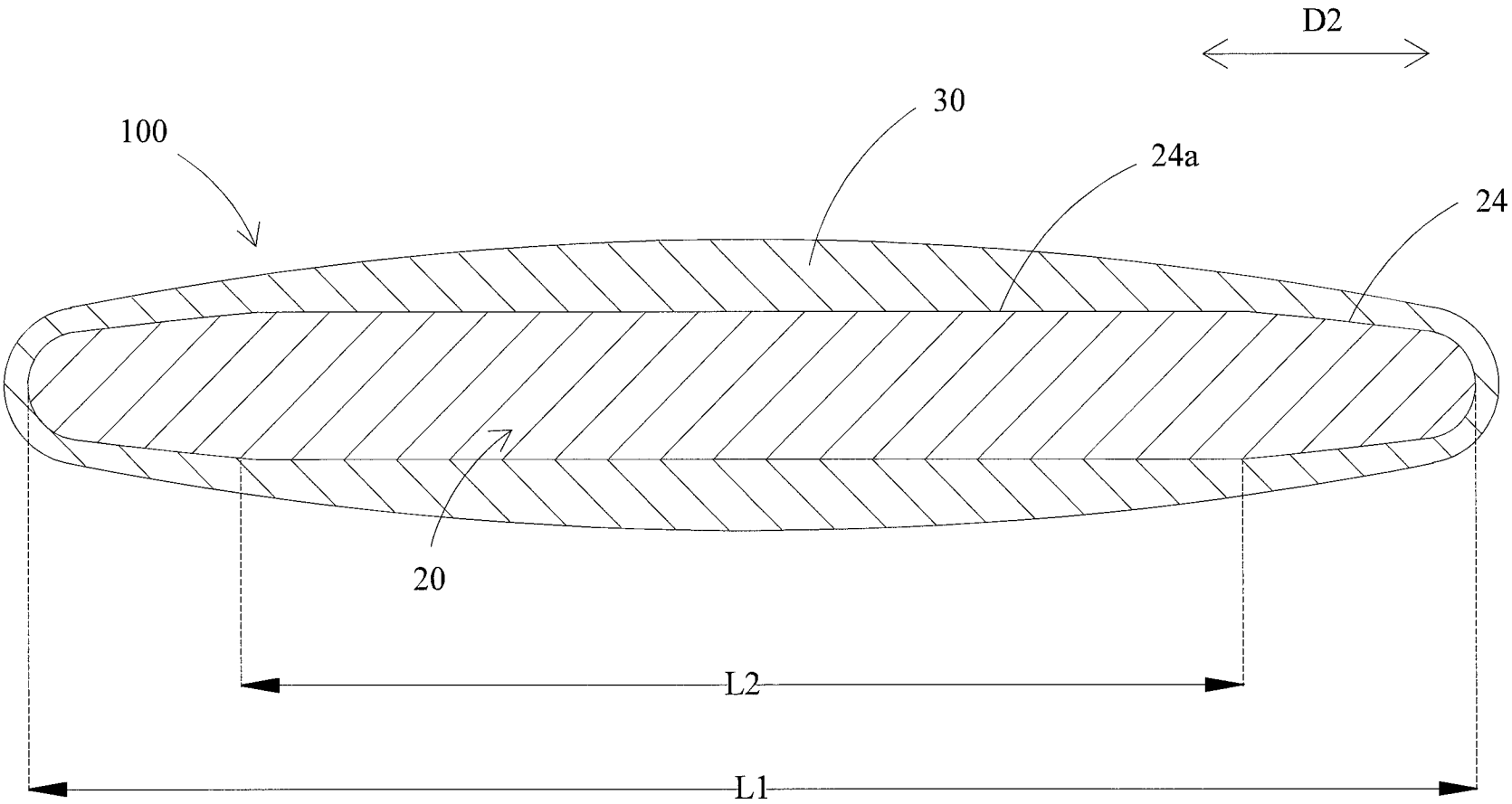
FIG. 4 is a cross-sectional view of the slat of the window covering in the embodiment of the present invention along the 4-4 line in FIG. 3.

A slat 100 of an embodiment of the present invention for a window covering is shown in FIG. 3 and FIG. 4, wherein the slat 100 has approximately the same shape and appearance with a conventional slat (e.g., those shown in FIG. 1), and also includes a core material 20 and a covering layer 30. The core material 20 is substantially a long, thin piece. By referring to the shape of the core material 20, a longitudinal direction D1 and a transverse direction D2 can be defined, wherein the longitudinal direction D1 is an extending direction of the core material 20, while the transverse direction D2 is perpendicular to the longitudinal direction D1. The longitudinal direction D1 and the transverse direction D2 together define an imaginary plane which is substantially corresponding to the long, thin shape of the core material 20.

The core material 20 has a side surface 22 on each side thereof in the longitudinal direction D1, and a part of a surface of the core material 20 connecting peripheries of the two side surfaces 22 is defined as a continuous surface 24. In other words, the surface the core material 20 can be divided into the two side surfaces 22 and the continuous surface 24. The continuous surface 24 has a flat segment 24*a* on each of two opposite sides thereof (i.e., in the current embodiment, a top side and a bottom side in FIG. 4), wherein each of the flat segments 24*a* is a flat surface having no curves and bends. In the current embodiment, the flat segments 24*a* are parallel to each other; however, this is not a limitation of the present invention. In addition, each of the flat segments 24*a* in the current embodiment respectively connects the side surfaces 22 located on the two sides of the core material 20. In other words, a length of each of the flat segments 24*a* in the longitudinal direction D1 equals a length of the core material 20 itself in the longitudinal direction D1. However, this feature is not a limitation of the present invention, either.

As it can be seen in FIG. 3 and FIG. 4, the core material 20 is a long object, and therefore its extending length (i.e., the length of the core material 20 in the longitudinal direction D1) is way greater than a cross-sectional width thereof (i.e., a maximum length of the core material 20 in the transverse direction D2, or a length of its transverse axis). Wherein, the cross-sectional width of the core material 20 is defined as a first length L1, a length of each of the flat segments 24*a* in the transverse direction D2 is defined as a second length L2. The second length L2 could be modified in different embodiments to meet different requirements, but should preferably be 1% to 80% of the first length L1 in any circumstances. In the current embodiment, the core material 20 is made of a medium-density fiberboard (MDF); however, the selection of the material of the core material 20 is not limited as described herein. MDF is formed through high temperature and high pressure, and one characteristic of MDF is having uneven density, wherein the part of MDF with the highest density is where near the surface, and the density becomes lower as getting closer to an inner middle of the fiberboard. By providing the flat segments 24*a*, it would not be necessary to over-cut and over-trim the core material 20 during the manufacturing process. Whereby, parts of the MDF with higher density could be retained. More specifically, an inner middle part of the core material 20 has the lowest density, and the density becomes higher as getting closer to each of the flat segments 24*a*, i.e., a location of the core material 20 provided with each of the flat segments 24*a* has the highest density. Density would directly affect the bending resistance performance of the core material 20, and therefore, with longer second length L2 of each of the flat segments 24*a*, the core material 20 would have better bending resistance capability. In other words, the length of each of the second lengths L2 is substantially directly proportional to the bending resistance capability of the core material 20. In the current embodiment, the second lengths L2 of the flat segments 24*a* are equal on the top and bottom sides. However, in practice, the flat segments 24*a* could also have different second lengths L2.

Figure 2:
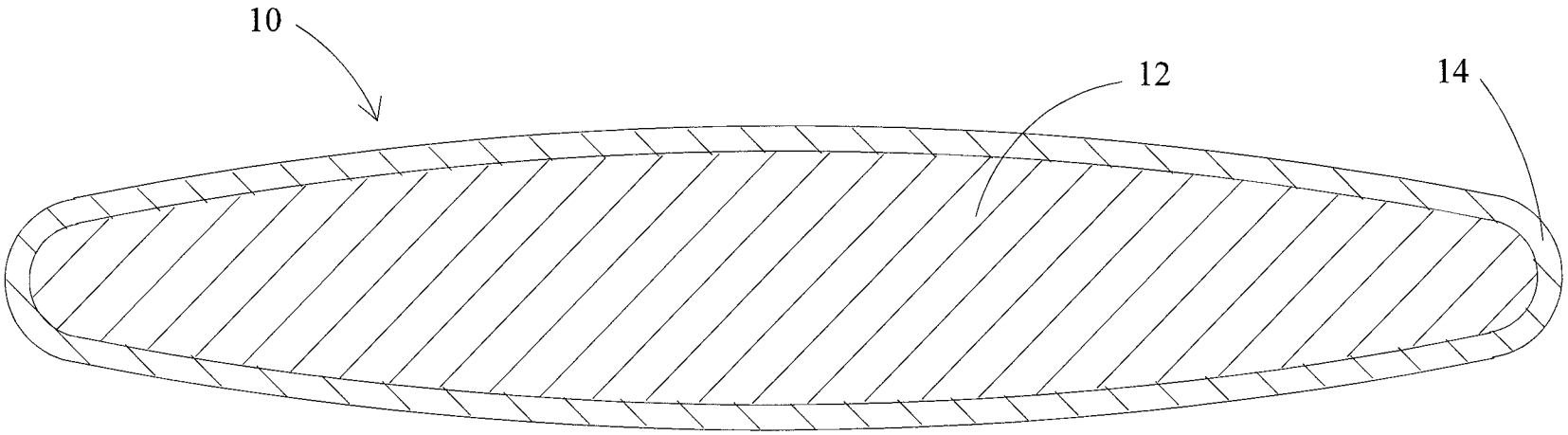
(Prior Art) FIG. 2
FIG. 2 is a cross-sectional view of a slat of the conventional window shutter along the 2-2 line in FIG. 1.

In addition, the continuous surface 24 of the core material 20 is covered by the covering layer 30, wherein, in the current embodiment, the covering layer 30 is a cured liquid coating coated on the continuous surface 24. However, the covering layer 30 is not limited to be made by the method mentioned above. In order to further enhance the bending resistance capability of the slat 100 while keeping the substantially same shape and appearance with a conventional slat (e.g., the one shown in FIG. 1 and FIG. 2), the covering layer 30 has a greater thickness on each of the flat segments 24*a*. In other words, a thickness of the covering layer 30 on each of the flat segments 24*a* is greater than a thickness of the covering layer 30 covering any parts of the continuous surface 24 other than each of the flat segments 24*a*. In the current embodiment, the covering layer 30 has the same thickness on each of the flat segments 24*a*. However, in practice, the thicknesses of the covering layer 30 on the flat segments 24*a* could be different for the top and bottom sides. The covering layer 30 could provide additional bending resistance capability for the resultant slat 100. Generally speaking, the covering layer 30 with greater thickness would provide higher bending resistance capability, wherein the thickness is substantially directly proportional to the bending resistance capability.

With the aforementioned design, the parts of the core material 20 of the slat 100 with the highest density would not be required to be discarded or trimmed for the purpose of shaping. Furthermore, the covering layer 30 with uneven thickness could particularly enhance the bending resistance capability in a middle section of the slat 100. As a result, the bending resistance capability in the middle section of the slat 100 would be sufficient to withstand the weight of the slat 100 itself even when the long slat 100 is connected to a fixture (e.g., a window frame) with only two ends thereof. Whereby, the slat 100 would unlikely get fractured or broken even after being used for a long period or as being applied with an external force in improper ways.

It needs to be clarified that, in the aforementioned embodiment, the slat 100 in the present invention is substantially spindle-shaped in the cross-section, the core material 20 has two corresponding flat segments 24*a* provided on opposite sides (i.e., the top and bottom sides in FIG. 4) of the continuous surface 24, and the side surfaces 22 are both directly exposed without being covered by the covering layer 30; however, these features are not limitations of the present invention. In other embodiments, the slat 100 could have a different cross-sectional shape, and could only have one single flat segment 24*a* provided on any side of the continuous surface 24 of the core material 20. Or, the side surfaces 22 could be covered by the covering layer 30, as long as the covering layer 30 of the slat 100 has a greater thickness on each of the flat segments 24*a*. In practice, a thickness of the core material 20 could gradually reduce toward two ends in the longitudinal direction D1, so as to make each of the side surfaces 22 converge into an edge, and no longer has an obvious planar structure. Though said edges (i.e., the converging side surfaces 22) can be only called "lateral sides" instead of "surfaces" by geometric definition, they have no specific functions, and therefore said edges are merely design choices of the side surfaces 22 mentioned in the above embodiment. In other words, each of the side surfaces 22 referred in the present invention is not limited to have a planar structure.

It must be pointed out that the embodiments described above are only some preferred embodiments of the present invention. All equivalent structures which employ the concepts disclosed in this specification and the appended claims should fall within the scope of the present invention.

What is claimed is:

1. A slat of a window covering, comprising:

a core material, which is long and narrow, and has a side surface on each of two ends in a longitudinal direction, respectively, wherein a surface of the core material between the side surfaces is defined as a continuous surface; the continuous surface has a flat segment; and a covering layer covering the continuous surface of the core material;

wherein, a thickness of the covering layer on the flat segment is greater than a thickness of the covering layer on any other parts of the continuous surface;

wherein the core material is thickest in a part thereof provided with the flat segment;

wherein the core material is made of a medium-density fiberboard;

wherein the continuous surface further comprises another flat segment, and the flat segment and the another flat segment are respectively located on different sides of the continuous surface;

wherein the core material has uneven density, and the part thereof provided with the flat segment has a highest density;

wherein the covering layer is configured to provide a greater bending resistance over the flat segment and the another flat segment of the continuous surface.

2. The slat of claim 1, wherein the core material is defined to have a transverse direction perpendicular to the longitudinal direction; a length of the flat segment of the continuous surface in the transverse direction is 1% to 80% of a length of the core material in the transverse direction.

3. The slat of claim 1, wherein the flat segment connects the side surfaces located at the two ends of the core material in the longitudinal direction.

4. The slat of claim 1, wherein a thickness of the covering layer on the flat segment equals a thickness of the covering layer on the another flat segment.

5. The slat of claim 1, wherein the core material is defined to have a transverse direction perpendicular to the longitudinal direction; a length of each of the flat segments in the transverse direction is 1% to 80% of a length of the core material in the transverse direction.

6. The slat of claim 5, wherein the lengths of the flat segments of the continuous surface in the transverse direction are equal.

7. The slat of claim 1, wherein the flat segments of the continuous surface are parallel to each other.

8. The slat of claim 1, wherein each of the flat segments of the continuous surface connects the side surfaces located at the two ends of the core material in the longitudinal direction, respectively.

9. The slat of claim 1, wherein the covering layer is a cured liquid coating coated on the continuous surface of the core material.

* * * * *